US007021891B2

(12) United States Patent
Sanchez et al.

(10) Patent No.: US 7,021,891 B2
(45) Date of Patent: Apr. 4, 2006

(54) MICRO-IMPELLER MINIATURE CENTRIFUGAL COMPRESSOR

(75) Inventors: Eduardo A. Sanchez, San Francisco, CA (US); James G. Maveety, San Jose, CA (US); Gregory M. Chrysler, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/323,528

(22) Filed: Dec. 18, 2002

(65) Prior Publication Data

US 2004/0120802 A1 Jun. 24, 2004

(51) Int. Cl.
*F01D 3/02* (2006.01)

(52) U.S. Cl. ..... 415/98; 415/203; 416/183; 416/184; 416/185; 361/695

(58) Field of Classification Search ..... 415/98, 415/203; 416/183–185; 361/695
See application file for complete search history.

(56) References Cited

U.S. PATENT DOCUMENTS

| | | | | |
|---|---|---|---|---|
| 1,546,323 | A * | 7/1925 | Spowage | 415/98 |
| 1,602,008 | A * | 10/1926 | Germeyer | 415/98 |
| 1,602,009 | A * | 10/1926 | Germeyer | 415/98 |
| 1,831,272 | A * | 11/1931 | Tyler | 415/98 |
| 1,941,037 | A * | 12/1933 | Lenz | 415/98 |
| 2,401,206 | A * | 5/1946 | Van Rijswijk | 416/186 R |
| 5,529,457 | A * | 6/1996 | Terasaki et al. | 415/208.3 |
| 6,327,145 | B1 * | 12/2001 | Lian et al. | 361/697 |
| 6,398,495 | B1 * | 6/2002 | Kazianus | 415/206 |
| 6,535,386 | B1 * | 3/2003 | Sathe et al. | 361/695 |

OTHER PUBLICATIONS

"Compressor Section"; Internet article; Dec. 10, 2002*; http://www.aircav.com/gencompr.html.
"Centrifugal Compressor"; Internet article; Dec. 10, 2002*; http://www.tpub.com/fireman/48.htm.
"Side Channel Compressors"; Internet article; Dec. 10, 2002*; http://www.becker-international.com/en_pg007.html.
"Fan Selection—quick techniques . . . " Internet article; Flomerics—Jan. 1998, Techbrief.htm; http://www.electronics-cooling.com/Resources/EC_Articles/JAN98/techbrief.htm.

* cited by examiner

*Primary Examiner*—Theresa Trieu
(74) *Attorney, Agent, or Firm*—Schwabe, Williamson & Wyatt, P.C.

(57) ABSTRACT

A back-to-back double-flow bi-directional thrust-balanced micro-impeller for use in optimized compression cycles of small volumetric flow rates is provided. The back-to-back micro-impeller is a component of a compressor capable of generating a pressure head suitable for maintaining the flow rate needed for dissipating heat, such as produced by an electronic component. The back-to-back micro-impeller provides a fluid path on both sides of the micro-impeller, imparting an equal momentum (or velocity) to the fluid. The left and right compressor sections provide a balancing of forces generated by high-pressure fluid against the two sides of the micro-impeller. This reduces vibrational forces and provides a balancing force on the shaft which reduces the thrust on the shaft in a direction away from the gas flow path. Also, the approximately equally distributed mass about the rotation axis X, provides for a balanced impeller which is desirable when operated at high rotation speeds.

18 Claims, 4 Drawing Sheets

FIG. 3
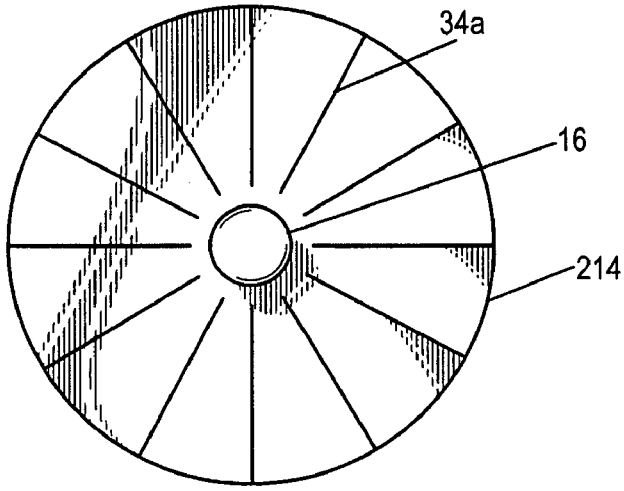
FIG. 4
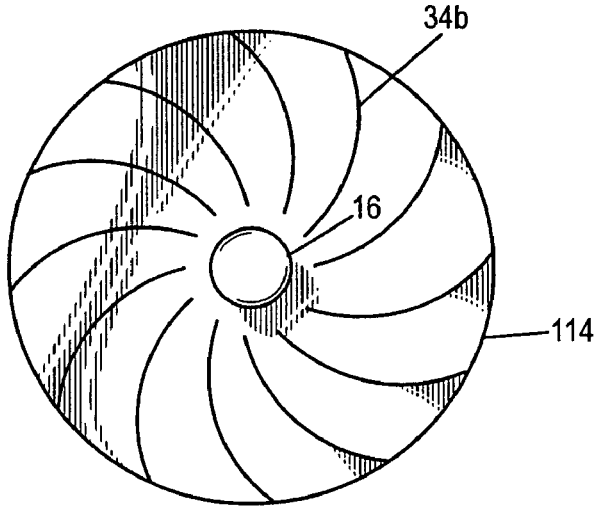
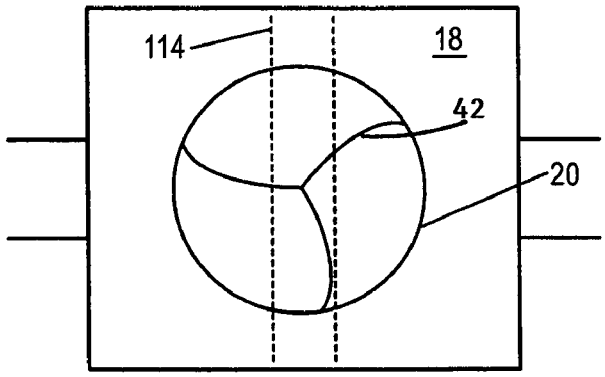
FIG. 5

| Specified Operating Conditions (SI) | | | |
|---|---|---|---|
| **Parameter** | **Symbol** | **Value** | **Units** |
| Molecular weight | mw | 102.03 | Kg/Kgmol |
| Ratio of specific heats | k1 | 1.23 | - |
| Compressibility | Z1 | 0.935 | - |
| Pressure | P1 | 370 | Kpa |
| Pressure | P2 | 908 | Kpa |
| Temperature (inlet) | T1 | 15 | C |
| Mass flow rate | m(dot) | 0.00107 | Kg/s |
| Specific Gas Constant | R | 0.08149 | J/Kg*K |

FIG. 6

| For conditions: 200W at 35C amb. Cold Plate T=25C | | | |
|---|---|---|---|
| Item | Known Design | Embodiment | Units |
| Gas | RF134a | RF134a | - |
| Molecular weight | 102.03 | 102.03 | Kg/Kgmol |
| Pressure Ratio | 2.45 | 2.45 | - |
| Power Required | 42.5 | 15 | Watts |
| Casing Height | 88.9 | 50.8 | mm |
| Casing Diameter | 61.98 | 76.2 | mm |
| Frictional Forces | Inherent | Reduced | - |
| Vibration | >0 (ecc. CAM) | 0 (balanced) | - |
| Speed | 3500 | 36,785 | RPM |

FIG. 7

| Metric | Embodiment | Known Blower | Known Rotary Vane |
|---|---|---|---|
| Pressure ratio | High (1-3.5 single stage) | Low (1.1-1.2) | Any arrangement very high (~18) |
| Function | Compress gas | Gas mover | Compress gas |
| Multistage | Yes | Yes (but very rarely) | No |
| Vibration | Low | Low | High |
| Blade Discharge Angle | Backward leaning (typically $\leq 90°$) | Forward leaning (typically $> 90°$) | N/A |
| Gas Velocity | Sonic (high) | Sonic | - |
| Vol. Flow Rate (cfm) | High | High | High |
| Power Consumption | Low | High | High |

FIG. 8

MICRO-IMPELLER MINIATURE CENTRIFUGAL COMPRESSOR

FIELD OF THE INVENTION

The present invention relates to fluid handling equipment, and more particularly, to a centrifugal compressor including a micro-impeller for the cooling of electronic devices.

BACKGROUND OF INVENTION

Certain electronic devices can generate a significant amount of heat. This heat must be removed from the device to prevent overheating leading to failure of the device. With current trends for increasingly smaller electronic devices, there is a need for smaller cooling systems.

One approach used in the art relies on miniaturizing large industrial/residential compressors such as reciprocating (piston) or rotary compressors. These systems work well for their current applications, but have limited application for sensitive electronic equipment because of there inherent large vibrational forces and power requirements. These compressors rely on positive displacement, such as a moving piston or rotary vane, and intermittent operation, to compress the working fluid, which is commonly a gas.

Electronic cooling units must be designed to a unique set of conditions that yield a narrow operating range for the electronic device's volumetric flow rate capacity. This translates into little flexibility for future applications, as any further increase in cooling needs is likely to restrict the operating range of the electronic device or push it out of specification.

Electronic devices found in advanced computing devices require stringent thermal-management needs. Specifically, the ever-increasing power dissipation needs of microprocessors found in advanced electronic devices and systems are quickly approaching available cooling system limits of volumetric flow rate needed for cooling beyond the operating range of existing systems.

New fluid handling systems for cooling of electronic devices are needed not only for the needs of future electronic devices, but to provide more efficient systems for current devices. They must provide for exceptionally small-scale integration, not interfere with the electrical interface of other components within the microelectronic package, and inexpensive to manufacture.

BRIEF DESCRIPTION OF DRAWINGS

FIG. 3 is a front view of an embodiment of the micro-impeller, in accordance with an embodiment of the invention;

FIG. 4 is a front view of the embodiment of the micro-impeller of FIG. 2;

FIG. 5 is a top view of the compressor of FIG. 1;

FIG. 6 is a table presenting operating conditions for compressor comparison experiment;

FIG. 7 is a table presenting the operating characteristics required of each compressor to maintain the performance requirement of the experiment of FIG. 6; and FIG. 8 is a table comparing the characteristics of the back-to-back micro-impeller compressor with currently available fluid moving systems.

DESCRIPTION

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

An impeller in accordance with the present invention operates in a compressor and has blade geometry suited to impel high velocity to gas molecules to produce a high discharge pressure.

Figure 1:
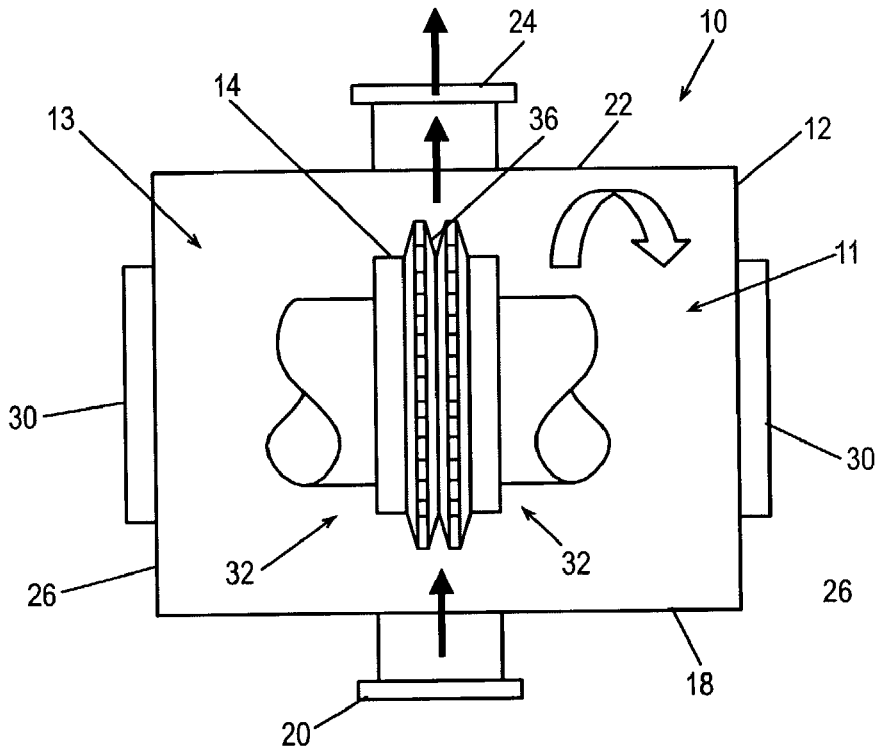
FIG. 1 is a side cut-away view of a compressor comprising a back-to-back micro-impeller, in accordance with an embodiment of the invention.

FIG. 1 is a side cut-away view of a compressor 10, in accordance with an embodiment of the invention. The compressor 10 comprises a housing 12, a micro-impeller 14, and a shaft 16. The housing 12 comprises an inlet side 18 having an inlet aperture 20, an outlet side 22 opposite the inlet side 18 having an outlet aperture 24 in axial alignment with the inlet aperture 20, and two opposing sides 26 each having a shaft penetration 30 adapted to accept a shaft 16 there through. The housing 12 has a predetermined internal volume to accept the micro-impeller 14 and to permit proper flow there through. The shaft penetrations 30 are adapted to accept the diameter of the shaft 16 to permit the shaft 16 to extend through the housing 12 and rotate within the penetrations 30. The micro-impeller 14 is positioned within the housing 12, parallel and in alignment with the inlet aperture 20 and outlet aperture 24.

In operation, the compressor 10 draws the working fluid into the housing 12 through the inlet aperture 20 by vacuum created by the rotation of the micro-impeller 14. The fluid passes through the micro-impeller 14 which compresses the fluid and expels the fluid out of the outlet aperture 24 under high pressure.

The compressor 10 is adapted for, but not limited to, use in a refrigeration cycle as part of a cooling system for high performance computing platforms.

Figure 2:
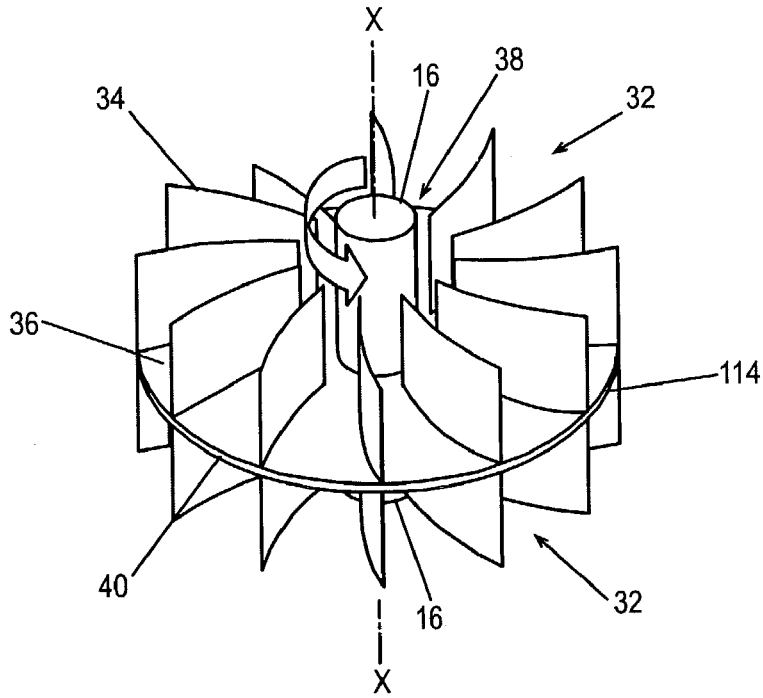
FIG. 2 is a perspective view of a back-to-back micro-impeller, in accordance with an embodiment of the invention.

FIG. 2 is a perspective view of a back-to-back double-flow bi-directional-thrust-balanced micro-impeller 114 for use in optimized compression cycles of small volumetric flow rates, in accordance with an embodiment of the present invention. The back-to-back micro-impeller 114 is a component of a compressor capable of generating a pressure head suitable for maintaining the flow rate needed for dissipating heat, such as, but not limited to, 200 W.

The back-to-back micro-impeller 114 provides a fluid path on both sides 32 of the micro-impeller 114, imparting an equal momentum (or velocity) to the fluid. This provides an equal force loading on each side of the micro-impeller 114 which reduces frictional and vibration forces as compared with single-sided impellers.

Also, the approximately equally distributed mass about the rotation axis X, provides for a balanced rotor, defined as the back-to-back micro-impeller 114 and shaft 16, which is desirable when operated at high revolutions-per-minute (RPM).

The back-to-back micro-impeller 114 comprises a plurality of spaced-apart blades 34 that extend from a base plate 36 (also referred herein as a disk) a predetermined distance. The blades 34 are geometrically varied so that the most efficient transfer of energy from the blades 34 to the working fluid is achieved. The design of the blades 34 depends on the efficiencies and pressure rise required of the compressor 10.

The blades 34 radiate from proximate the shaft 16 to the outer edge 40 or proximate the outer edge 40 of the base plate 36. The blades 34 are spaced-apart from the shaft a predetermined distance defining an impeller inlet 38. The working fluid enters the micro-impeller 114 at the impeller inlet 38 and exits proximate the outer edge 40 of the base plate 36.

FIG. 3 is a front view of an embodiment of the micro-impeller 214 in accordance with the present invention. The micro-impeller 214 comprises a plurality of spaced-apart blades 34*a* that radiate straight outward from shaft 16.

FIG. 4 is a front view of the embodiment of the micro-impeller 114 of FIG. 2. The micro-impeller 214 comprises blades 34*b* radiating outwards towards the outer edge 40 of the base plate 36. The micro-impeller 214 can be rotated in either a clockwise or counter-clockwise direction, depending on the blade design. Further, the blades 34*b* can curve in the opposite direction than that shown in FIG. 4.

In another embodiment of the micro-impeller (not shown) in accordance with the present invention, the blades twist as they radiate out to the outside diameter of the impeller. Twist is defined as a continuous change in the angle of the blade to the base plate as a factor of a change in the distance from the shaft. A blade that twists is referred to as being 3D, whereas one that does not twist and simply extends perpendicular to the base plate regardless of distance from the shaft is referred to as being 2-D.

The micro-impeller 114 comprises a base plate 36 from which the blades 34 extend. The blades 34 can be coupled to the base plate 36 using common processes, such as, but not limited to, welding, and milling from a solid billet. The blades 34 must be able to withstand the forces required to convert the torque from the shaft 16 to the working fluid as well as the centrifugal forces at the blade tips and base plate outer edge 40.

In another embodiment in accordance with the present invention, the back-to-back micro-impeller 114 is a component of a single stage compressor 10. A stage is defined as one compression region, whereas a two stage compressor will have two compression regions connected in series.

In another embodiment in accordance with the present invention, the back-to-back micro-impeller 114 is a component of a multiple stage compressor (not shown). The choice between compressor designs depends on the pressure ratio required and the thermodynamic state desired of the working fluid during the compression cycle. This flexibility provides that the micro-impeller 114 in accordance with the invention can be designed for many different applications.

Referring to FIG. 1, the compressor 10 would be referred to as a back-to-back, single stage compressor. The base plate 36 provides a physical barrier between a left compressor section 13 and a right compressor section 11, with flow that runs parallel to each other. The base plate 36, of the back-to-back micro-impeller 114, separates the two parallel fluid streams which have the same inlet conditions.

The benefit of having a left compressor section 13 and a right compressor section 11 is that there is a balancing of forces generated by high-pressure fluid against the two sides 32 of the micro-impeller 114. This reduces vibrational forces as well as provides a balancing force on the shaft 16 which reduces the thrust on the shaft 16 in a direction away from the gas flow path.

The material from which the micro-impeller 114 is made should be capable of taking the form of the micro-impeller 114, and being durable and corrosion resistant to the working fluid. A suitable material for many applications is aluminum, but the micro-impeller 114 is not limited only to aluminum. Other materials include other metals and plastics.

One benefit of a compressor 10 comprising a micro-impeller 114 is that there is small deviation in discharge pressure for a given change in volumetric flow rate. The compressor 10 can deliver relative large volumetric flow range (−65%–120% of flow capacity) over a relatively minor change in output discharge pressure.

FIG. 5 is a top view of the compressor 10 of FIG. 1. The inlet aperture 20 comprises optional fixed guide vanes 42 which provide volumetric flow control. The guide vanes 42 add pre-swirl to the fluid stream entering the micro-impeller 114 which reduces the axial component of the absolute velocity vector, and therefore, controls the fluid capacity to the micro-impeller 114. This in effect adds speed control equivalency, and is ideal for single stage, or in this case, parallel stage compressors 10. The guide vanes 42 can be fixed at various angles to maximize performance of the micro-impeller 114 at flow regimes specific to a particular operating requirement.

An embodiment of the back-to-back micro-impeller compressor 10 in accordance with FIG. 1 was experimentally validated and compared with a conventionally-designed compressor (one-sided impeller). FIG. 6 is a table presenting the specific operating conditions and compressor physical characteristics that were used in the experiment. Each compressor was operated to support the requirement of dissipating 200 W to maintain a coldplate temperature at 25° C. with an ambient temperature of 35° C.

FIG. 7 is a table presenting the operating characteristics required of each compressor to maintain the requirement. It is demonstrated that the back-to-back micro-impeller compressor 10 can support the performance requirements with a significant decrease in power consumption with lower vibration than the conventional design.

FIG. 8 is a table comparing the characteristics of the back-to-back micro-impeller compressor 10 with currently available fluid moving systems. One key difference between a blower and a compressor is the achieved pressure ratio. The compressor 10 comprising a back-to-back micro-impeller 114 in embodiments in accordance with the present invention, produces a pressure ratio of 2.45 using a heavy molecular weight gas (102.03 Kg/KgMol) as a working fluid. A blower, in contrast, would not be expected to deliver more than 1.2 pressure increase over inlet pressure with the same working fluid.

In other embodiments in accordance with the present invention, the back-to-back micro-impeller is a component of a compressor having an outlet aperture. The compressor is collocated with at least one electronic component of a microelectronic system such that the outlet aperture is located proximate the at least one electronic component. Examples of a microelectronic system include, but not limited to: a microelectronic package, such as, but not limited to a microprocessor; a microelectronic circuit board, such as, but not limited to a computer memory and/or video card; and an electronic component within an electronic housing, such as, but not limited to, a power supply and/or a disk drive housed within a computer enclosure.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. An apparatus comprising:

a disk having a first side, a second side, a center, an axis of rotation, and an edge;

a shaft extending outward from the center, on the first side and on the second side, along the axis of rotation; and a first and second plurality of spaced-apart blades that project from the first side and the second side of the disk respectively, and the first and second plurality of spaced-apart blades radiating from proximate the shaft, defining a first and second plurality of impeller inlets, to the edge or proximate the edge, defining a first and second plurality of impeller outlets, respectively, the first and second plurality of spaced-apart blades also defining a first and second plurality of flow passages from the first and second plurality of impeller inlets to the first and second plurality of impeller outlets for the working fluid to enter the first and second plurality of impeller inlets and exit the first and second plurality of impeller outlets respectively, and the blades being further adapted to approximately equalize a combined distributed mass of the disk, the blades, and a working fluid about the axis of rotation.

2. The apparatus of claim 1, wherein either the first plurality of blades, the second plurality of blades, or both radiate straight outward from proximate the shaft to the edge or proximate the edge.

3. The apparatus of claim 1, wherein either the first plurality of blades, the second plurality of blades, or both radiate in a swept-back direction, from proximate the shaft to the edge or proximate the edge.

4. The apparatus of claim 1, wherein either the first plurality of blades, the second plurality of blades, or both radiate in a swept-forward direction, from proximate the shaft to the edge or proximate the edge.

5. The apparatus of claim 1, wherein the blades projecting from the second side, project in symmetric relationship to the blades projecting from the first side.

6. A compressor for an electronic device cooling system, comprising:

a housing having two opposite first sides and two opposite second sides, each first side having a centrally positioned shaft aperture, one of the second sides having a centrally positioned inlet aperture, the other of the second sides having a centrally positioned outlet aperture;

a disk having a first side, a second side, a center, an axis of rotation, and an edge;

a shaft extending outward from the center, on the first side and on the second side along the axis of rotation, through the first sides; and a first and second plurality of spaced-apart blades that project from the first side and the second side of the disk respectively, and the first and second plurality of spaced-apart blades radiating from proximate the shaft, defining a first and second plurality of impeller inlets, to the edge or proximate the edge, defining a first and second plurality of impeller outlets, respectively, the first and second plurality of spaced-apart blades also defining a first and second plurality of flow passages from the first and second plurality of impeller inlets to the first and second plurality of impeller outlets respectively, for a working fluid to enter the inlet aperture to flow into the first and second plurality of impeller inlets and exit corresponding ones of the first and second plurality of impeller outlets, then flowing out of the outlet aperture, and the blades being further adapted to approximately equalize a combined distributed mass of the disk, the blades, and a working fluid about the axis of rotation.

7. The compressor of claim 6, wherein either the first plurality of blades, the second plurality of blades, or both radiate straight outward from proximate the shaft to the edge or proximate the edge.

8. The compressor of claim 6, wherein either the first plurality of blades, the second plurality of blades, or both radiate in a swept-back direction, from proximate the shaft to the edge or proximate the edge.

9. The compressor of claim 6, wherein either the first plurality of blades, the second plurality of blades, or both radiate in a swept-forward direction, from proximate the shaft to the edge or proximate the edge.

10. The compressor of claim 6, wherein the blades projecting from the second side in symmetric relationship to the blades projecting from the first side.

11. The system of claim 6 wherein at least one guide vane is provided in or near the inlet aperture.

12. An electronic system having an electronic device cooling system, comprising:

at least one electronic component;

a housing having two opposite first sides and two opposite second sides, each first side having a centrally positioned shaft aperture, one of the second sides having a centrally positioned inlet aperture, the other of the second sides having a centrally positioned outlet aperture;

a disk having a first side, a second side, a center, an axis of rotation, and an edge;

a shaft extending outward from the center, on the first side and on the second side along the axis of rotation, extending through the first sides; and a first and second plurality of spaced-apart blades that project from the first side and the second side of the disk respectively, and the first and second plurality of spaced-apart blades radiating from proximate the shaft, defining a first and second plurality of impeller inlets, to the edge or proximate the edge, defining a first and second plurality of impeller outlets, respectively the first and second plurality of spaced-apart blades also defining a first and second plurality of flow passages from the first and second plurality of impeller inlets to the first and second plurality of impeller outlets, respectively, and the electronic component being located proximate the outlet aperture, and the blades being further adapted to approximately equalize a combined distributed mass of the disk, the blades, and a working fluid about the axis of rotation.

13. The electronic system of claim 12, wherein either the first plurality of blades, the second plurality of blades, or both radiate straight outward from proximate the shaft to the edge or proximate the edge.

14. The electronic system of claim 12, wherein either the first plurality of blades, the second plurality of blades, or both radiate in a swept-back direction, from proximate the shaft to the edge or proximate the edge.

15. The electronic system of claim 12, wherein either the first plurality of blades, the second plurality of blades, or both radiate in a swept-forward direction, from proximate the shaft to the edge or proximate the edge.

16. The electronic system of claim 12, wherein the blades projecting from the second side, project in a symmetric relationship to the blades projecting from the first side.

17. The system of claim 12 wherein at least one guide vane is provided in or near the inlet aperture.

18. The system of claim 12 operable to create a pressure ratio between the inlet aperture and outlet aperture.

* * * * *